US005961321A

United States Patent [19]

Vetterick et al.

[11] Patent Number: 5,961,321

[45] Date of Patent: Oct. 5, 1999

[54] DISTRIBUTIVE INTEGRAL GAS BURNER

[75] Inventors: Richard C. Vetterick, Akron; Clifford F. Eckhart, Damascus; John V. Koslosky, Akron, all of Ohio

[73] Assignee: The Babcock & Wilcox Company, New Orleans, La.

[21] Appl. No.: 08/760,078

[22] Filed: Dec. 4, 1996

[51] Int. Cl.[6] ..... F23D 14/46

[52] U.S. Cl. ..... 431/350; 431/354

[58] Field of Search ..... 431/350–354, 431/186, 189, 159; 239/414, 401

[56] References Cited

U.S. PATENT DOCUMENTS

| | | | |
|---|---|---|---|
| 244,746 | 7/1881 | Gordon . | |
| 741,456 | 10/1903 | Cannon . | |
| 1,911,177 | 5/1933 | Beck . | |
| 1,950,046 | 3/1934 | Cone | 158/104 |
| 1,995,417 | 3/1935 | Cone | 158/104 |
| 2,256,080 | 9/1941 | Eweryd et al. | 299/122 |
| 2,577,772 | 12/1951 | Kennedy | 431/350 |
| 3,178,161 | 4/1965 | Yeo et al. | 431/354 |
| 3,219,096 | 11/1965 | Goeke et al. | 158/99 |
| 3,615,249 | 10/1971 | Martols | 23/277 C |
| 4,009,989 | 3/1977 | Bitterlich | 431/178 |
| 4,523,905 | 6/1985 | Lewis | 431/350 |
| 5,102,329 | 4/1992 | Lifshits | 431/354 |
| 5,139,414 | 8/1992 | Nakamoto et al. | 431/176 |
| 5,423,675 | 6/1995 | Kratsch | 431/354 |
| 5,461,853 | 10/1995 | Vetterick | 60/39.02 |
| 5,483,906 | 1/1996 | Hofton | 110/260 |
| 5,505,146 | 4/1996 | Laursen | 110/264 |

OTHER PUBLICATIONS

The Babcock & Wilcox Company, Steam/Its Generation and Use, 40th ed., 1992, pp. 25–7 to 25–9 and 31–3 to 31–4.

*Primary Examiner*—James C. Yeung

*Attorney, Agent, or Firm*—Daniel S. Kalka; Robert J. Edwards

[57] ABSTRACT

A burner apparatus useful in steam producing or waste heat boilers. The apparatus includes a fuel delivery means placed between two airfoils that define an elongated venturi throat. The airfoils may be provided with a plurality of perforations to allow a secondary gas (ambient air and/or spent flue gas) to be supplied to the venturi throat for reducing $NO_x$ production.

3 Claims, 5 Drawing Sheets

DISTRIBUTIVE INTEGRAL GAS BURNER

BACKGROUND OF THE INVENTION

1. Field of the Invention

The present invention generally relates to a burner for use in a furnace and more particularly to a gas fired burner useful in steam producing or waste heat boilers.

2. Description of the Related Art

Gas burners for use in steam producing boilers that use air as a combustion oxidant typically involve highly turbulent and relatively high pressure drop designs which mix the fuel and air in the furnace section of the boiler. The flame envelope produced by such burners, whether they are arranged singly or in a multiple array, fills the open boiler furnace. Examples of known boilers that may be equipped with burners having the described operating characteristics are disclosed in the publication *Steam: its generation and use,* 40th ed., 1992, at pages 25–7 to 25–9, published by The Babcock & Wilcox Company.

Waste heat recovery boilers, also known as heat recovery steam generators, can utilize a duct burner design to boost the amount of heat available to the boiler. Typically, burners of such a design are placed in an open duct and are used to heat air or gases in the duct. Unlike the highly turbulent burners employed in above-referenced steam producing boilers, duct burners operate at higher excess air levels. A known waste heat recovery boiler design is depicted and described in the aforementioned Babcock & Wilcox publication at page 31–3.

The burner of the present invention, which has been termed a distributive integral gas burner (DIGB), has been developed to combine certain desirable features of the more conventional turbulent burners with those of duct burners. One of the objectives of the present invention has been to provide a burner with relatively low air side pressure drop while maintaining high burner efficiency with low excess air. Included among the benefits anticipated with such a burner are the ability to perform burner firing in narrower furnace confines, to reduce the power consumption of forced draft fans used with the boiler, to obtain reduced $NO_x$ emissions and to increase boiler steam ratings within a given boiler footprint. In order to achieve such benefits, the present invention utilizes a vertical fuel manifold which is placed between two air foils that define a vertically elongated venturi throat therebetween. Another aspect of the present invention, also aimed at the achievement of the enumerated benefits, is that it includes air foils which may have perforations to allow a secondary gas to be supplied behind the air foils and injected through the perforations and into the flame for reducing $NO_x$ production.

U.S. Pat. No. 244,746 discloses a plurality of transversely elongated rectangular ducts which alternately carry fuel and air and together form a horizontally elongated gas burner. The patent does not indicate that air foils should be provided between the alternating air and fuel passages or that perforations should be provided for admitting a secondary gas.

U.S. Pat. No. 741,465 employs curved tubular passages for directing a flame.

U.S. Pat. No. 1,911,117 discloses circular gas jets having a venturi structure downstream of the jets.

U.S. Pat. Nos. 1,950,046 and 1,99417 describe the use of air foil structures in a gas burner; however, elongated passages bounded by air foils to form a venturi are not disclosed in either of these patents.

U.S. Pat. No. 3,219,096 describes a structure having elongated passages, but the passages are provided for combining different gaseous fuels for combustion. The described structure does not employ elongated throats between adjacent air foils.

U.S. Pat. No. 4,009,989 discloses elongated throat channels for a fuel plus air mixture; however, air foils are absent from the structure.

U.S. Pat. No. 5,102,329 utilizes a gas manifold and U.S. Pat. No. 5,139,414 discloses a burner with primary and secondary combustion chambers.

SUMMARY OF THE INVENTION

It is a primary objective of the present invention to provide a gas burner design that operates with low fuel pressure, low combustion velocities and low turbulence and in a very small amount of furnace volume.

Accordingly, one aspect of the present invention is drawn to a burner having a manifold for delivering a gaseous fuel, or a mixture of gaseous fuel and other gases such as combustion air and/or spent flue gas, into a mixing chamber. The mixing chamber is provided with an inlet for combustion air, which is located upstream of the manifold.

Another aspect of the present invention is drawn to a burner having a pair of air foils situated diametrically opposite to each other within the mixing chamber and slightly downstream of the manifold. The air foils define a long, narrow and straight venturi throat which terminates at an outlet of the mixing chamber.

In one embodiment of the invention, the air foils may be used as conduits to introduce gases such as spent flue gas or ambient air or a combination of the two into the combustion zone where the mixture of combustion air and fuel gas flows through the venturi throat. In such case, each air foil is provided with a means for delivering a gas to its interior and a plurality of perforations in its surface, which permit the gas supplied to the air foil interior to flow through the air foil and into the venturi throat. It is believed that where spent flue gas and/or an abundance of excess air is supplied through the air foil the effect will be to assist in minimizing $NO_x$ formation from the combustion process. Ambient air alone may be delivered through the air foils where high mass air heaters are desired, and also to assist in minimizing $NO_x$ formation.

It will be noted from the descriptive matter provided hereinbelow that the burner of the present invention is a linear type design opposed to a circular or port design, and can be any length consistent with the associated equipment. It also will be noticed that the burner may be positioned in a variety of orientations. It may be positioned vertically to allow close proximity with the vertical "water walls" without causing "flame impingement". It is envisioned that such positioning capability will facilitate quicker heat absorption which in turn will prevent the flue gas temperatures from reaching threshold levels above which thermal $NO_x$ forms. It also is envisioned that the low velocities and low pressure resistances inherent in the present invention will help to save forced draft fan power, and in the case of turbine exhaust gas application, will allow for low back pressure values and eliminate the need for fans to boost turbine exhaust gas static pressure. It is further envisioned that the burner of the present invention will exhibit higher turndown ratio operation (in the range of 20:1) which in turn will allow the burner to operate with low specific volume cold fresh air for straight combustion, or high specific volume, high temperature, low $O_2$ content engine exhaust gas for combustion air in a combined cycle type of operation. In contrast to the burner of the present invention, known high turbulence burners generally are limited to approximately 5:1 turn down with 10:1 being extremely good.

The various features of novelty which characterize the invention are pointed out with particularity in the claims annexed to and forming a part of this disclosure. For a better understanding of the invention, its operating advantages and specific objects intended to be obtained by its uses, reference is made to the accompanying drawings and descriptive matter in which preferred embodiments of the invention are illustrated.

DESCRIPTION OF THE PREFERRED EMBODIMENTS

Figure 1:
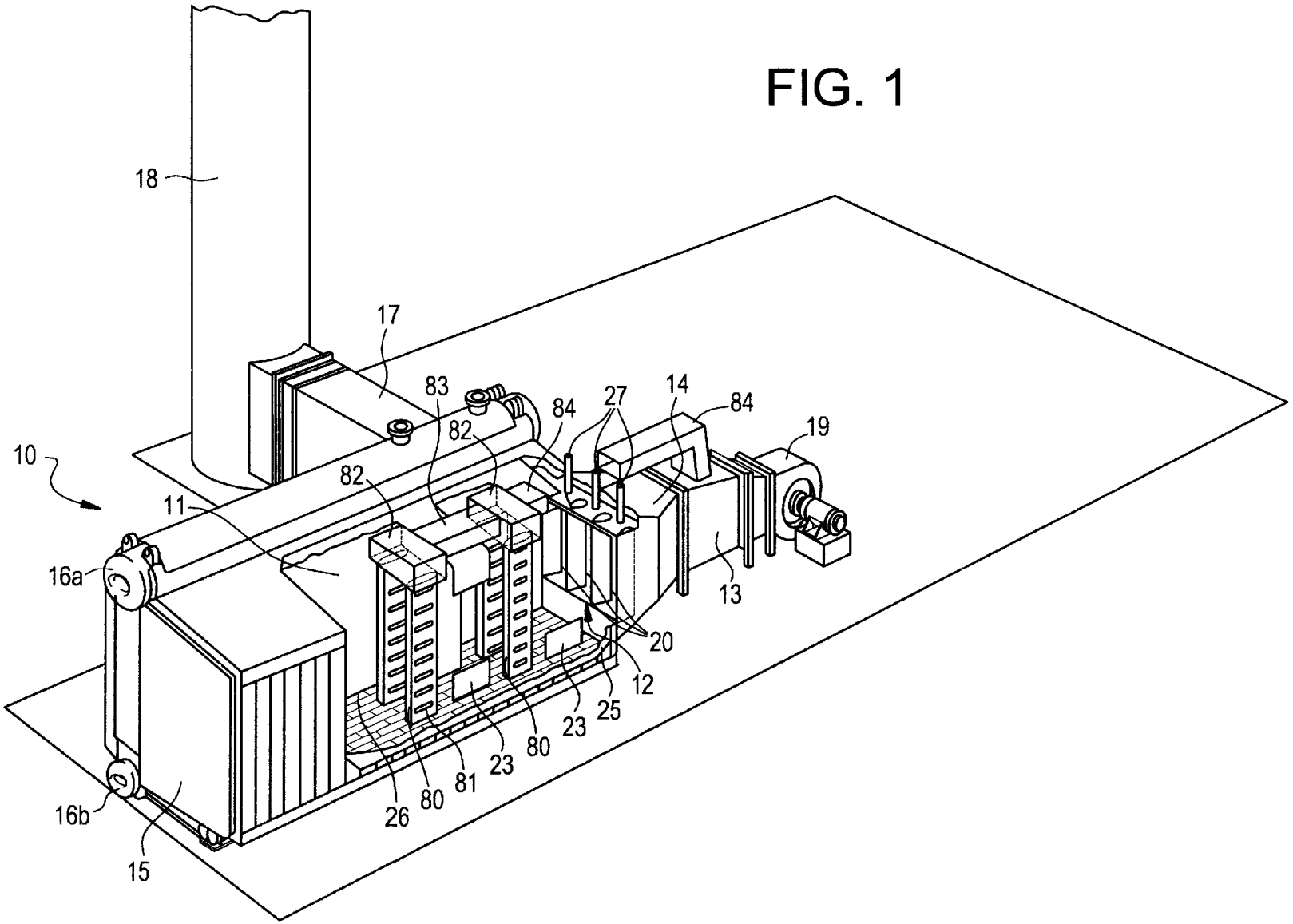
FIG. 1 is a perspective view, partly in section, of a steam producing boiler apparatus wherein the burner of the present invention may be used.

Referring to the drawings generally, wherein like numerals represent the same or functionally similar elements throughout the several drawings, and to FIG. 1 in particular, there is shown one example of a steam producing boiler generally designated 10 in which the burner of the present invention may be used. Boiler 10 has a furnace space 11 for receiving flames from a multiple burner array 12. Burner array 12 is located at an entrance to furnace space 11, preferably in an inlet windbox or plenum 14 connected to inlet duct 13 of the boiler 10. Burner array 12 provides the fuel for combustion into the furnace space 11 of boiler 10. Boiler 10 also includes a back wall 15 at which combustion exhaust gases moving horizontally along furnace space 11 turn through 180 degrees and then move horizontally through a bank of boiler tubes (not shown) which are fluidically connected between upper and lower steam drums 16*a* and 16*b*, respectively. The combustion exhaust gases subsequently pass through exhaust gas flue 17 and leave the unit through a stack 18. Forced draft fan means 19 provides the necessary air for combustion at desired flow rates and static pressures to overcome all resistances in the system and exhaust the combustion gases to/through the stack 18.

Burner array 12 is comprised of a plurality of vertically extending and horizontally spaced burners 20 of the present invention. Each burner 20 receives fuel from a fuel manifold extending into the burner 20. The burners 20 are spaced across the width and height of the entrance to furnace space 11 to evenly distribute the fuel for combustion into the furnace space 11.

Figure 2:
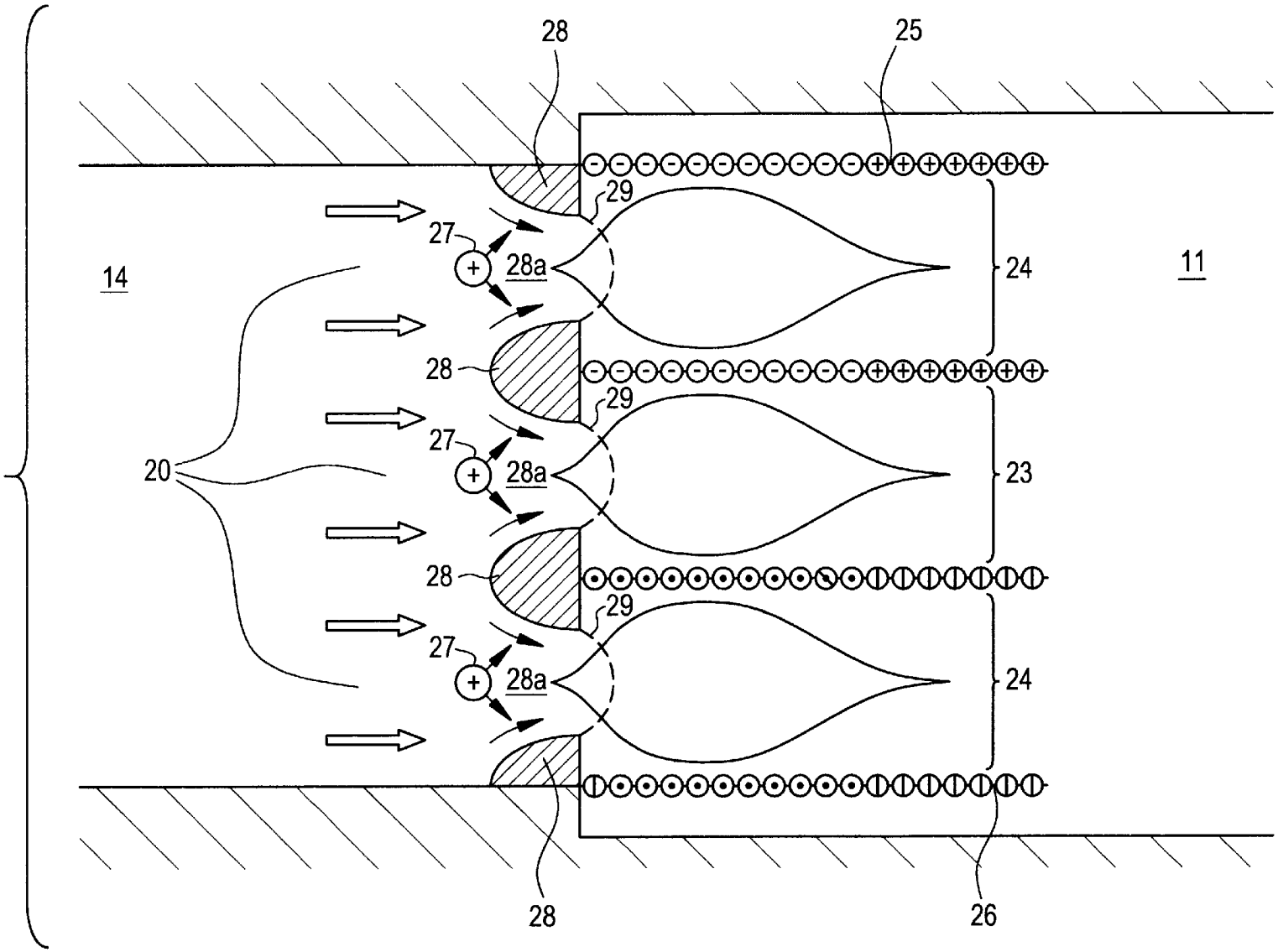
FIG. 2 is a sectional plan view, showing how the burner of the present invention might be arranged in a burner array in a steam producing boiler.

The boiler of FIG. 1 is further outfitted with one or more vertically extending, horizontally spaced chill tube sections or assemblies 23 within the furnace space 11. Assemblies 23 are comprised of boiler tubes 24 (as seen in FIG. 2) which are fluidically connected between upper and lower steam drums 16*a*, 16*b* of boiler 10 for immediately absorbing heat from the burner flames. Preferably,.each chill tube assembly 23 comprises a plurality of tubes 24 arranged in a single row that extends parallel with the combustion exhaust gas flow through the furnace space 11. One or more chill tube assemblies 23 may be provided, arranged adjacent to each other across the width of the furnace space 11. As shown in FIG. 1, the one or more chill tube assemblies 23 also may be provided in one or more rows, with two or more chill tube assemblies 23 in each row. FIG. 1 shows two (2) such rows, with a pair of chill tube assemblies 23 in each row. Advantageously, the burners 20 are positioned such that their flames are centered between adjacent chill tube assemblies 23, the first of which assemblies is situated immediately downstream of burner array 12.

In addition to the chill tube assemblies 23, the boiler 10 is provided with a vertically extending side wall tube assembly 25 and a vertically extending division wall tube assembly 26. Assemblies 25 and 26 are comprised of a plurality of boiler tubes 24, which also are fluidically connected between upper and lower steam drums 16*a*, 16*b* of boiler 10 for immediately absorbing heat from the burner flames. Typically, each of the assemblies 25 and 26 comprises a plurality of tubes 24 arranged in a single row that, like each tube row of the chill tube assemblies 23, extends parallel with the combustion exhaust gas flow through the furnace space 11.

The boiler 10 of FIG. 1 also is provided with one or more internal air duct assemblies 80 which are positioned within the furnace space 11 and in line with the chill tube assemblies 23. FIG. 1 shows two air duct assemblies 80. Each air duct assembly is provided with a plurality of apertures 81 which can take the form of a plurality of circular holes or elongated slots spaced along the walls forming the air duct assemblies 80. Each of the air duct assemblies 80 is connected at its top to air duct plenums 82. Air duct plenums 82 are connected by an interconnecting air duct 83. The air duct plenum 83 that is located closest to burner array 12 is connected to an air staging duct 84 which is in turn connected to inlet duct 13. A portion of the air flowing through inlet duct 13, which air has yet to be heated by burner array 12, is diverted into air staging duct 84 and transported ultimately to air duct assemblies where the air is discharged into the furnace space 11 through apertures 81. The air discharged through the apertures 81 serves to minimize oxygen availability at the base of the flame and thus minimize $NO_x$ formation and/or promote reburning of $NO_x$ in exhaust gas streams.

FIG. 2 provides a cross sectional view of a portion of boiler 10, wherein a plurality of horizontally spaced burners 20 of the present invention are illustrated in burner array 12 (FIG. 1). (While FIG. 2 shows a row of three burners 20, it should be understood that the number of burners 20 in any row of burner array 12 need not be limited to that number.) As indicated by the arrows on the far left side of FIG. 2, combustion air supplied from inlet windbox or plenum 14 enters each burner 20 and flows toward a tubular, vertical fuel manifold 27 which is situated on the central axis of the burner 20. Each fuel manifold 27 is fluidically connected with a main fuel line (not shown) which supplies pressurized gaseous fuel to each of the manifolds 27. As combustion air flows past each fuel manifold 27, the pressurized fuel is discharged through a plurality of apertures provided in each manifold 27 and combines with the combustion air. In FIG. 2, discharge of fuel from each manifold 27 is indicated by two arrows emanating from the periphery of each manifold 27. Preferably, each manifold 27 will have the apertures evenly arranged and extending longitudinally along the wall of the manifold 27; but, numerous other arrangements of holes are understood to be advantageous in different velocity regions. The apertures will be situated on the periphery of the wall so that the fuel flowing from each arrangement will be directed generally toward a line tangential with an airfoil 28 located just slightly downstream of manifold 27. Accordingly, each burner nozzle 20 shown in FIG. 2 is provided with a pair of airfoils 28 which are arranged diametrically opposite to one another within the burner nozzle 20. Each airfoil 28 vertically extends from the top to the bottom walls of burner nozzle 20 and thereby defines with its curved surface a venturi throat 28*a* through which the mixture of combustion air and fuel flows toward the outlet end of the burner nozzle 20. Before reaching the outlet end, the mixture of combustion air and fuel is ignited by a known ignition means (not shown in FIG. 2); combustion occurs and the combustion gases produced thereby expand at the discharge end of the venturi throat 28*a*. The flame discharged from the burner 20 is directed into furnace space 11 where chill tube assembly 23, side wall tube assembly 25 and division wall assembly 26 are located. Boiler tubes 24 that comprise the assemblies 23, 25 and 26 absorb thermal energy from the flame and transfer that energy to steam drums 16*a*, 16*b* for steam production.

Figure 3:
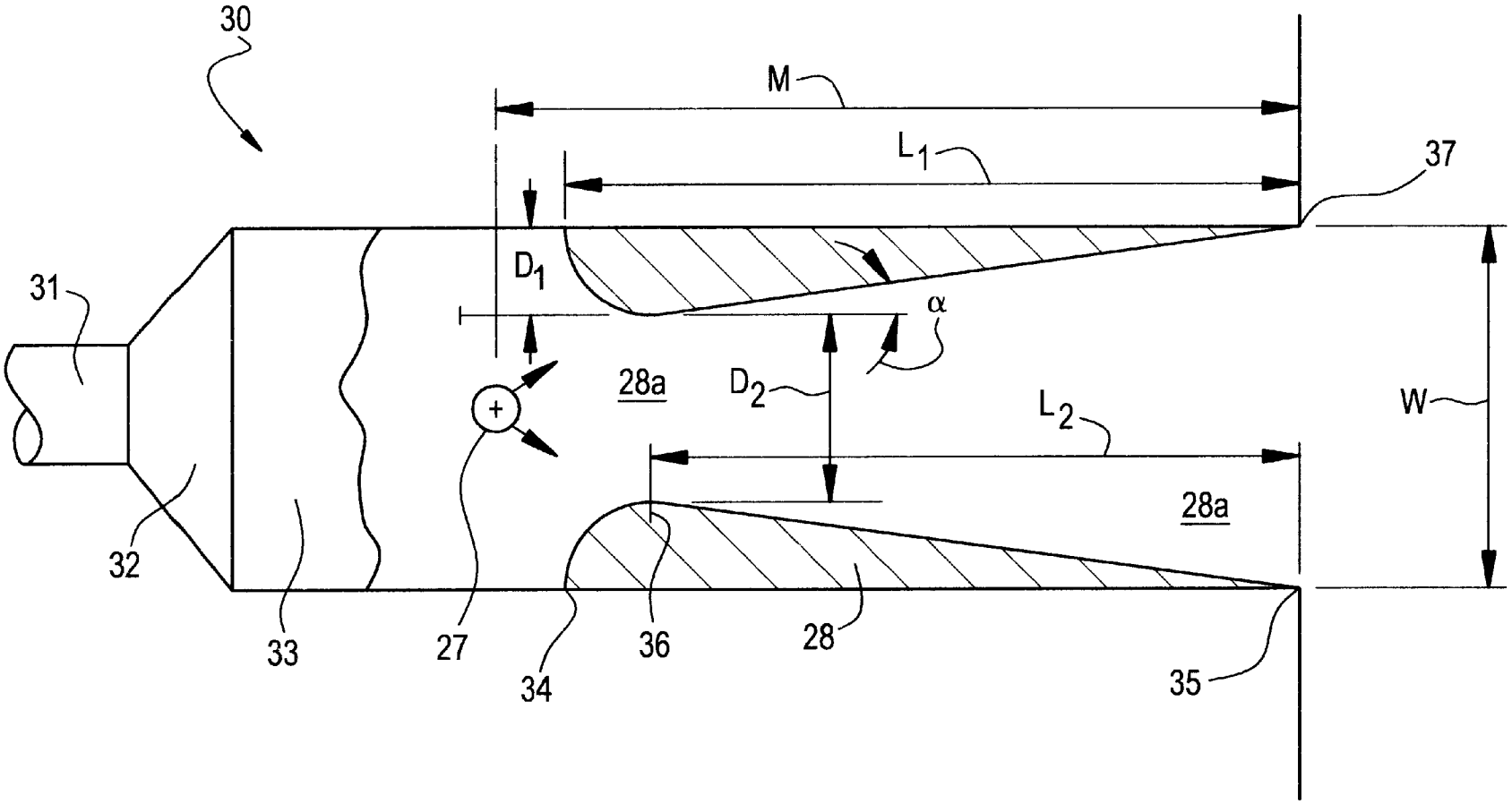
FIG. 3 is a plan view, partly in section, illustrating a first embodiment of the burner of the present invention.

FIG. 3 is a plan view, in partial section, showing the makeup of a singular burner 30 of the present invention. (Certain minor differences between the burners 20 shown in FIG. 2 and the burner 30 depicted in FIG. 3 may be observed; however, such differences are largely attributable to the physical arrangement of the burners 20 in the rows of burner array 12. It will be seen from the following description that the singular burner 30 essentially has the same pertinent functional features and operating characteristics as the row arrangement of burners 20 described in FIG. 2.) Burner 30 is provided with a combustion air supply conduit 31 and a combustion air inlet section 32 through which combustion air flows into a long, rectangular mixing chamber 33 having width W and height H (not shown in FIG. 3, but see FIG. 5). Tubular, vertical fuel manifold 27 is situated on the central axis of the mixing chamber 33 at a point that is downstream of the inlet section 32 where the combustion air flows into the mixing chamber. The fuel manifold 27 is in fluid communication with a gaseous fuel supply means (not shown), or alternatively, a means (also not shown) for supplying any one of a mixture of gaseous fuel and combustion air; gaseous fuel and an inert gas, such as spent flue gas; or gaseous fuel, combustion air and an inert gas. Where a fuel/air, a fuel/air/inert gas, or a fuel/inert gas mixture is provided to the manifold 27, the combustion air and/or inert gas may be introduced into the gaseous fuel by either forced or induced techniques before the fuel flows into the manifold 27. In the case of a fuel/air mixture, it has been observed through testing of the present invention that the quantity of fresh air injection into the gaseous fuel stream is very important, particularly so that the stoichiometric air flow into the fuel is maintained below a combustible mixture. In order to achieve good flame formation and clean burnout with low carbon monoxide (CO), it has been observed that it is necessary to have at least four percent (4%) of the stoichiometric oxygen ($O_2$) requirements as premix air. It also has been observed that to prevent premature burning and "flashbacks" it is necessary to keep the premix air below 40 percent of the stoichiometric requirements. Most often, tests of the present invention were conducted with premix air at quantities between five percent (5%) and twelve percent (12%) of stoichiometric conditions. Additionally, introduction of inert gas (such as spent flue gas) into the fuel gas may help to minimize $NO_x$ formation. It has been observed that the low pressures at which the fuel manifold 27 operates reduces the power required to raise the inert gas pressure to a level high enough to flow into the manifold 27.

As in the case of the burners 20 depicted in FIG. 2, fuel, or the fuel/air, the fuel/air/inert gas, or fuel/inert gas mixture, is discharged into the flow of combustion air supplied to the mixing chamber 33 from conduit 31. The fuel (or mixture) is discharged through a multitude of evenly distributed perforations (depicted by the arrows emanating from manifold 27) and is directed tangentially toward the two vertical airfoils 28 each of which is situated just downstream of the manifold 27 and along opposite walls of mixing chamber 33. Preferably, the airfoils 28 will be fabricated of a solid piece of heat resistant, metallic or ceramic matter. Alternatively, the airfoils 28 may be formed of a piece of heat resistant, rigid sheet metal that will define a dead air space between the sheet metal and the vertical wall of the mixing chamber 33.

Each airfoil will have a leading edge 34, a trailing edge 35 and an apex 36. As shown in FIG. 3, the trailing edge 35 is situated at the outlet 37 of mixing chamber 33. The leading edge 34 is located at a distance $L_1$ from the outlet 37, and the apex 36 is positioned at a distance $L_2$ from the outlet 37 and at a distance $D_1$ from the vertical side wall of mixing chamber 33. The portion of the airfoil 28 that extends between the apex 36 and the trailing edge 35 will be inclined at an angle $\alpha$ relative to the vertical side wall of the mixing chamber 33. The distance between opposing apexes of the airfoils 28 is designated by dimension $D_2$ in FIG. 3. The fuel manifold 27 will be situated at a distance M from the outlet 37 of the mixing chamber. It should be noted that the aforementioned dimensions for the airfoils 28 and the manifold 27 may vary according to the specific equipment with which the burner nozzle 30 will be utilized as well as the combustion characteristics that are desired or required of the burner nozzle 30 itself.

Just as in the case of the burners 20 depicted earlier in FIG. 2, the airfoils 28 define a venturi throat 28*a* through which the mixture of combustion air from conduit 31, gaseous fuel discharged from the fuel manifold 27 and any other gases introduced through the manifold 27 flow. Ignition of the mixture is established in the venturi throat 28*a* by an ignition means (not shown) and combustion occurs as the combustion gases produced thereby expand toward the outlet 37. The gases then further expand into the furnace space 11.

Figure 4:
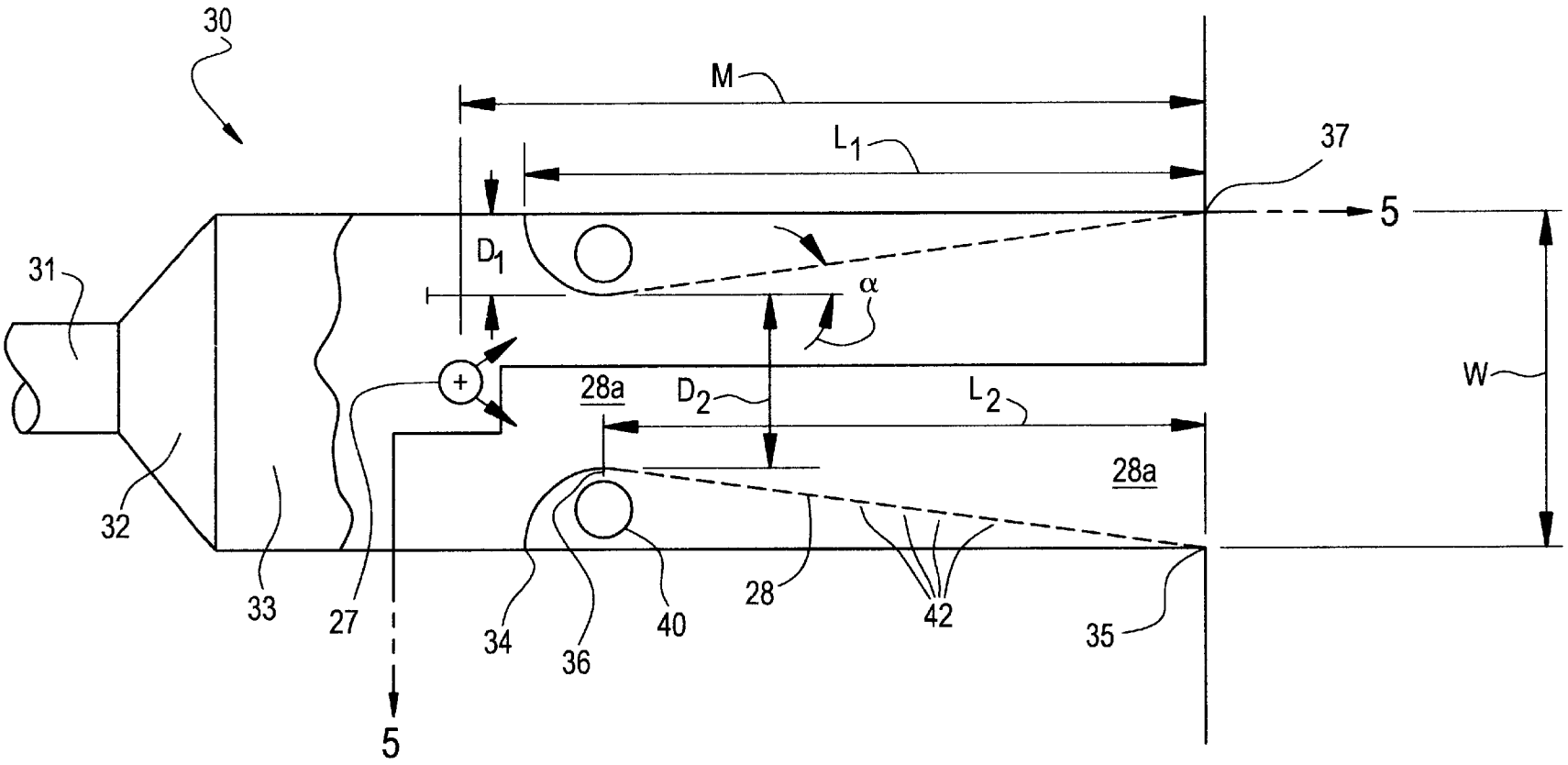
FIG. 4 is a plan view, partly in section, illustrating a second embodiment of the burner of the present invention.
Figure 5:
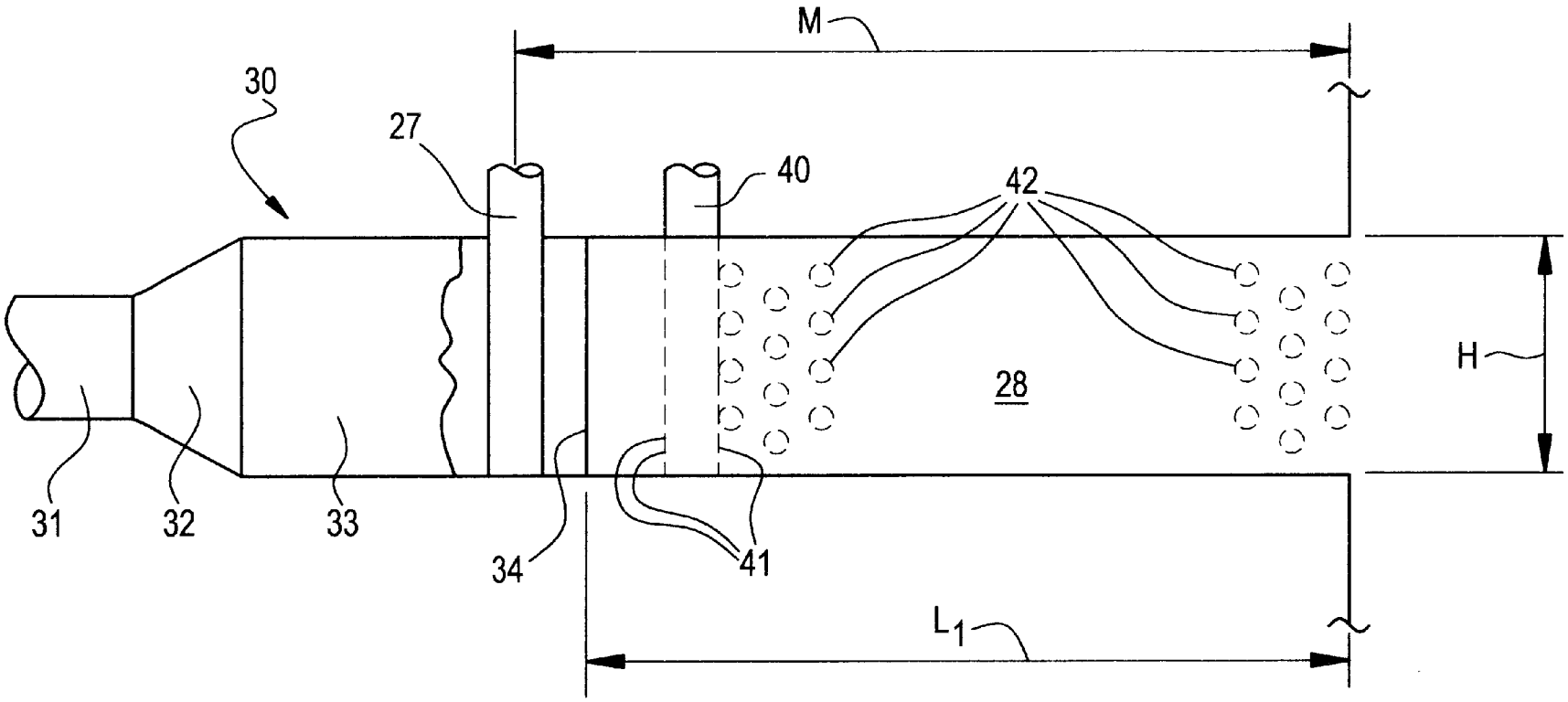
FIG. 5 is a side elevational view, partly in section along line 5—5 of FIG. 4, showing the second embodiment of the burner of the present invention.

FIG. 4 and FIG. 5 illustrate another embodiment of the singular burner 30. In this second embodiment, burner 30 is provided with means for introducing additional gases into venturi throat 28*a* through airfoils 28, each of which airfoil will be fabricated from a piece of heat resistant, rigid sheet metal. More specifically, burner 30 is provided with a tubular airfoil gas delivery means 40 to which spent flue gases or ambient air, or both, may be supplied under pressure to the interior of each air foil 28. As shown in FIG. 4, the airfoil gas delivery means 40 is positioned between the vertical wall of mixing chamber 33 and the airfoil 28 and near the apex 36. As indicated in FIG. 5, the airfoil gas delivery means 40 preferably extends from the bottom wall of mixing chamber 33 up to and through the top wall of chamber 33. As also indicated by FIG. 5, the airfoil gas delivery means 40 is provided with a plurality of perforations or apertures 41 in its wall so that gas provided to delivery means 40 flows evenly distributed into the interior of the airfoils 28. The airfoils 28 are provided with a plurality of perforations or apertures 42 which allow the gas behind the airfoils 28 to flow into venturi throat 28*a* and mix with the combustion air supplied through conduit 31 and the fuel or mixture of fuel and other gases discharged through fuel manifold 27. The velocities and pressures of the gas delivered to venturi throat 28*a* through airfoil 28 will vary according to the process and desired effects. The extent of the surface area of the airfoil 28 that is provided with perforations or apertures 42 also can be varied to create desired effects. It has been suggested that spent flue gas may be introduced through airfoils 28 in instances where there is a need for lower $NO_x$ control and that ambient air may be provided through the airfoils 28 where high mass air heaters are desired.

While specific embodiments of the invention have been shown in detail to illustrate the application of the principles of the invention, it will be understood that the invention may be embodied otherwise without departing from such principles.

What is claimed is:

1. A gas burner for use in a boiler, the burner comprising:

a combustion air supply conduit;

a combustion air supply inlet connected to the combustion air supply conduit;

a mixing chamber having an inlet end connected to the combustion air supply inlet, an outlet end, a rectangular cross section and a longitudinal central axis;

a fuel supply means within the mixing chamber, passing through a wall of the mixing chamber and extending perpendicularly through the longitudinal central axis at a point that is located downstream of the combustion air supply conduit;

a pair of airfoils each having a leading edge, a trailing edge and an apex, and being situated within, and on opposing walls of, the mixing chamber, parallel to and downstream of the fuel supply means, with the leading edge and the trailing edge extending transversely along the mixing chamber wall and with the trailing edge being situated at the outlet end of the mixing chamber, the airfoils thus defining between them a venturi throat in the mixing chamber;

wherein the fuel supply means is a tubular manifold having a plurality of apertures arranged in at least two rows extending longitudinally along the wall of the manifold, the rows being situated such that any one of a gaseous fuel, a mixture of gaseous fuel and combustion air, a mixture of gaseous fuel, combustion air and an inert gas and a mixture of gaseous fuel and an inert gas can be discharged into the mixing chamber;

wherein the airfoils are comprised of a sheet of heat resistant, rigid material, affixed to the opposing walls of the mixing chamber and defining a space between the sheet and the wall to which the sheet is affixed;

wherein an airfoil gas delivery means is provided to the space between the sheet and the wall to which the sheet is affixed, and the airfoil includes a plurality of perforations allowing the space to be fluidically connected with the venturi throat; and wherein the airfoil gas delivery means is comprised of a conduit extending through a wall of the mixing chamber and parallel to the airfoil, the conduit having a plurality of perforations for introducing any one of a non combustible gas or a mixture of non combustible gases into the space and thereafter through the perforations in the airfoil and into the venturi throat.

2. A gas burner according to claim 1, wherein the non combustible gas is air.

3. A gas burner according to claim 1, wherein the mixture of non combustible gases consists of air and a spent flue gas.

* * * * *